US008387165B1

(12) United States Patent
Sakin

(10) Patent No.: US 8,387,165 B1
(45) Date of Patent: Mar. 5, 2013

(54) DISPOSABLE AND REUSABLE GERM SCREEN

(76) Inventor: Nailah Sakin, Satellite Beach, FL (US)

( * ) Notice: Subject to any disclaimer, the term of this patent is extended or adjusted under 35 U.S.C. 154(b) by 107 days.

(21) Appl. No.: 12/945,197

(22) Filed: Nov. 12, 2010

Related U.S. Application Data

(60) Provisional application No. 61/260,921, filed on Nov. 13, 2009.

(51) Int. Cl.
*A41D 13/08* (2006.01)

(52) U.S. Cl. ..... 2/16; 2/158; 2/163; 15/209.1

(58) Field of Classification Search ..... 2/16, 20, 2/158, 159, 161.6, 161.7, 163, 167, 169; 15/209.1
See application file for complete search history.

(56) References Cited

U.S. PATENT DOCUMENTS

| | | | | | |
|---|---|---|---|---|---|
| RE14,171 | E | * | 7/1916 | Hicks | 68/220 |
| 1,371,602 | A | * | 3/1921 | Butch | 2/20 |
| 1,478,914 | A | * | 12/1923 | Ritzenthaler | 15/227 |
| 2,068,182 | A | * | 1/1937 | Jackson | 2/20 |
| 2,621,784 | A | * | 12/1952 | Van Boytham | 206/361 |
| 2,695,999 | A | * | 12/1954 | Arnold | 2/20 |
| 2,925,605 | A | * | 2/1960 | Wheeler | 2/21 |
| 3,608,708 | A | * | 9/1971 | Storandt | 206/361 |
| 3,612,054 | A | * | 10/1971 | Matsuda et al. | 604/370 |
| 3,735,442 | A | * | 5/1973 | Lukas | 15/227 |
| 3,806,260 | A | * | 4/1974 | Miller | 401/7 |
| 4,071,921 | A | * | 2/1978 | Jury | 15/227 |
| 4,270,228 | A | * | 6/1981 | Gaiser | 2/158 |
| 4,617,684 | A | * | 10/1986 | Green et al. | 2/20 |
| 4,712,253 | A | | 12/1987 | Chen | |
| 4,718,125 | A | | 1/1988 | Derda | |
| 4,850,049 | A | | 7/1989 | Landis | |
| 4,902,283 | A | * | 2/1990 | Rojko et al. | 604/290 |
| 4,932,095 | A | * | 6/1990 | Kawase | 15/227 |
| 4,959,881 | A | * | 10/1990 | Murray | 15/227 |
| 5,196,244 | A | | 3/1993 | Beck | |
| 5,376,392 | A | * | 12/1994 | Ikegami et al. | 426/127 |
| 5,534,346 | A | | 7/1996 | Robinson | |
| 5,545,342 | A | * | 8/1996 | Beagle et al. | 510/299 |
| 5,649,336 | A | * | 7/1997 | Finch et al. | 15/104.94 |
| RE35,814 | E | * | 6/1998 | Olson | 206/278 |
| 5,761,746 | A | * | 6/1998 | Brown | 2/243.1 |
| 5,774,889 | A | * | 7/1998 | Gochanour | 2/16 |
| 5,799,331 | A | * | 9/1998 | Stewart | 2/159 |
| 5,833,646 | A | * | 11/1998 | Masini | 602/58 |
| 5,864,883 | A | | 2/1999 | Reo | |
| 5,881,388 | A | * | 3/1999 | Pratt | 2/163 |
| 5,962,102 | A | * | 10/1999 | Sheffield et al. | 428/92 |
| 5,975,083 | A | * | 11/1999 | Henderson, Jr. | 128/878 |
| 5,987,645 | A | * | 11/1999 | Teaster | 2/159 |
| 6,064,735 | A | | 5/2000 | Wilkes | |
| 6,215,871 | B1 | | 4/2001 | Conolly | |
| 6,254,625 | B1 | | 7/2001 | Rosenthal | |
| 6,460,190 | B1 | * | 10/2002 | Blum | 2/158 |
| 6,516,469 | B1 | | 2/2003 | Schaetzel | |
| 6,539,549 | B1 | * | 4/2003 | Peters, Jr. | 2/16 |

(Continued)

*Primary Examiner* — Khoa Huynh
*Assistant Examiner* — Andrew W Collins
(74) *Attorney, Agent, or Firm* — Bruce S. Steinberger; Law Offices of Brian S. Steinberger, P.A.

(57) ABSTRACT

Screen covers, devices, systems and methods of using the covers. The screen cover can have dome shaped front configuration and capital A rear side configuration that can be formed from a pliable material having a waterproof coated surface. The screen cover can have a closed front side, closed top, closed sides and an elastic band across the back having openings above and below the band. The screen cover can be disposable or reusable. Methods of using and removing the screen cover include removing the cover without contaminating the other hand that removes the cover.

10 Claims, 3 Drawing Sheets

U.S. PATENT DOCUMENTS

| | | | | |
|---|---|---|---|---|
| 6,607,226 | B1 * | 8/2003 | Poncy | 294/25 |
| 6,694,021 | B1 | 2/2004 | Julian | |
| 6,912,728 | B2 * | 7/2005 | Panella | 2/16 |
| 6,926,197 | B2 * | 8/2005 | Hed et al. | 229/403 |
| 8,006,319 | B2 * | 8/2011 | Bromberg | 2/161.7 |
| 2002/0023850 | A1 * | 2/2002 | Dean | 206/204 |
| 2002/0178482 | A1 * | 12/2002 | Samuelsson et al. | 2/16 |
| 2004/0020799 | A1 * | 2/2004 | Panella | 206/278 |
| 2004/0020815 | A1 * | 2/2004 | Panella | 206/440 |
| 2005/0079802 | A1 * | 4/2005 | Saunier et al. | 451/41 |
| 2006/0253955 | A1 * | 11/2006 | Kratsa et al. | 2/159 |
| 2007/0264894 | A1 | 11/2007 | Lerner | |
| 2008/0172767 | A1 | 7/2008 | Friedstrom | |
| 2008/0173299 | A1 * | 7/2008 | Bromberg | 128/112.1 |

* cited by examiner

DISPOSABLE AND REUSABLE GERM SCREEN

This invention claims the benefit of priority to U.S. Provisional Application 61/260,921 filed Nov. 13, 2009.

FIELD OF INVENTION

This invention relates to hygiene protection, in particular to disposable and reusable hand screen covers, devices, systems and methods of using the screens and removing the screens.

BACKGROUND AND PRIOR ART

Germs, bacteria, Viruses such as Swine Flu and the like, are often transferred by hand to hand or hand to object contact. Often door knobs contaminated by germs from one person's hands can be transferred to another person by contact with their hands.

Public bathrooms are a haven for germs being left on door knobs, sink handles, toilets, and the like. Other types of areas can include public telephones, grocery carts, public transportation conveyances such as airline and bus seats, and the like, are also harbingers of areas that can be become contaminated with germs.

In recent years it has become quite popular to use disposable sanitizer type wet tissues to wipe one's hands. However, the tissues leave the person with wet hands that must be separately dried. Also, the user often must wipe down the actual objects which only increases their contact with germ infested surfaces. Additionally, these wet tissues are not practical to be used for continuously gripping objects such as door knobs, toilet handles, grocery carts, telephones, and the like.

Various devices have been proposed over the years. For example, U.S. Pat. Nos. 5,196,244 to Beck and 4,718,125 to Derda et al. and U.S. Patent Application Publication 2008/0172767 to Friedstrom each describe devices that are disposable and are not reusable. Also these devices would be loose and not adequately stay on the user's hand.

U.S. Pat. No. 6,516,469 to Schaetzel describes a "diarrhea mitten", title with elastic band on the wrist. However, this device still loosely fits about the palm portion and sides of the hand, and this device is also disposable and would not be reusable.

U.S. Pat. Nos. 5,534,346 to Robinson, 5,864,883 to Reo; and 6,064,735 to Wilkes describe attachable type sanitary barriers. However, these devices must be fastened together to fasteners or adhesive and are also generally disposable and are not reusable.

U.S. Pat. No. 4,712,253 to Chen and U.S. Patent Application Publication 2007/0264894 to Lerner each describe gloves, that would be expensive to mass market and not easy to use when needed, and would not solve all the above problems.

Thus, the need exists for solutions to the above problems with the prior art.

SUMMARY OF THE INVENTION

A primary objective of the present invention is to provide disposable and reusable hand screen covers, devices, systems and methods for protecting individual hands from germs while coming into physical contact with commonly used areas.

A secondary objective of the present invention is to provide covers, devices, systems and methods of using disposable and reusable hand screen covers that protect hand(s) from germs while coming into physical contact with commonly used areas.

A third objective of the present invention is to provide one size fits all disposable and reusable hand screen covers and devices for protecting individual hands from germs while coming into physical contact with commonly used areas.

The fourth objective of the present invention is to provide screen covers, devices, systems and methods that are reusable over time.

The fifth objective of the present invention is to provide screen covers, devices, systems and methods that are both reusable and deposable.

A version of the screen cover for protecting hands from germs, can include a dome shaped sleeve having a closed front side, closed rounded top end, closed sides, and open bottom end and an open rear side, the sleeve having a waterproof exterior surface, and an elastic band across the rear side of the sleeve for attaching the closed sides to one another and forming an opening above and below the elastic band, wherein the sleeve is used for protecting a hand from contacting germ contaminated surfaces.

The sleeve can be reusable. The sleeve can be both reusable and disposable.

The rear side of the cover can have a capital A shaped configuration, while the front side of the sleeve has a closed dome shaped configuration.

A second elastic band can be located across a front side of the sleeve.

The water proof exterior surface can include a paper underlayer covered by a waterproof coating. The water proof exterior surface can include polyethylene. The screen cover can be formed from nylon. The screen cover can be formed from polyethylene and cotton in a blend, and the blend can be 65 polyethylene and 35 cotton.

A disinfectant can be used on at least the front side of the screen cover. A kit can be used containing the screen cover and a disinfectant spray.

A method of using and removing a screen shaped cover to protect one's hands from germs, can include the steps of providing a mitten shaped screen cover having a closed front side, a closed top and closed sides, and an elastic band across the back of the screen cover, inserting a hand into the screen cover so that the palm of the hand faces against the closed front side and the elastic band is across the back of the hand, pinching an interior portion of the closed top of the screen cover with the hand enclosed by the screen cover, grabbing the elastic band on the back of the screen cover with a second hand, and pulling the screen cover up and away from the enclosed hand with the second hand, and turning the screen cover inside out.

The method can include the step of disposing the turned inside out screen cover into the trash. The method can include the steps of applying disinfectant to the screen cover, and reusing the screen cover. The applying step can include spraying the screen cover with the disinfectant.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components will now be described.

Figure 1:
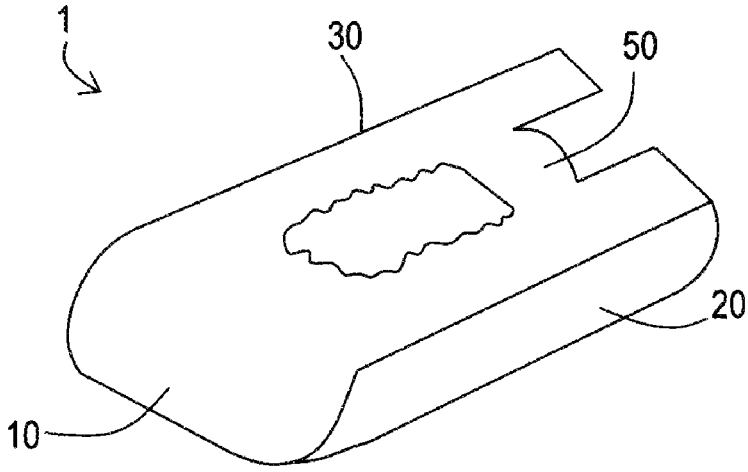
FIG. 1 is a perspective rear side view of the novel screen cover
Figure 2:
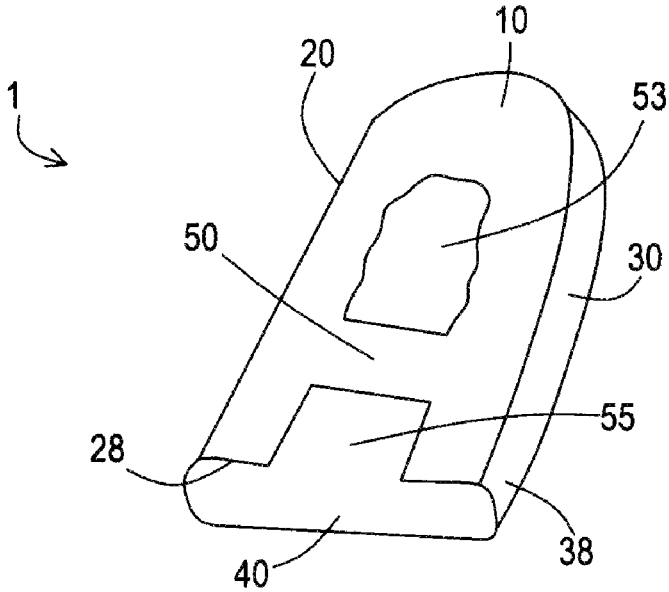
FIG. 2 is a perspective end view of the right end of the screen cover of FIG. 1.
Figure 3:
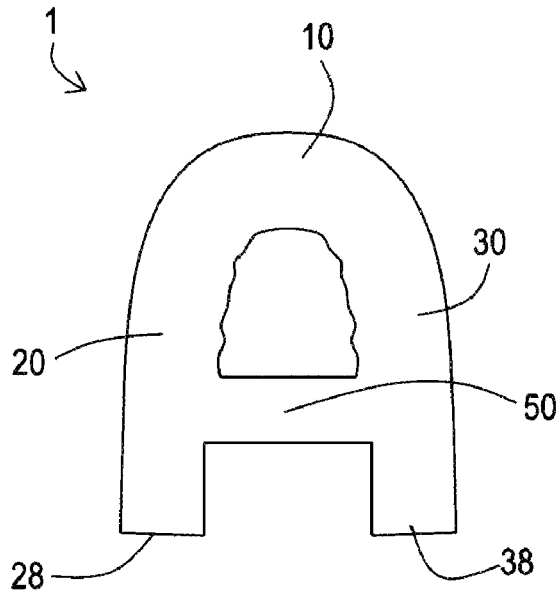
FIG. 3 is a rear view of the screen cover of FIG. 1.
Figure 4:
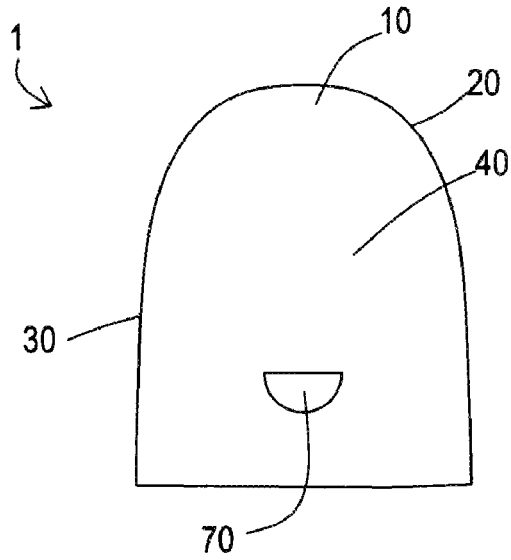
FIG. 4 is a front view of the screen cover of FIG. 1.

1 Screen cover
10 Closed tip end
20 left side
28 left base end
30 right side
38 right base end
40 front side
50 rear elastic band
53 opening above elastic band
55 opening below elastic band
70 front elastic band
100 Second cover
110 closed tip end
120 closed left side
130 closed right side
140 closed front side
150 rear elastic band
170 front elastic band FIG. 1 is a perspective rear side view of the novel screen cover 1. FIG. 2 is a perspective end view of the right end of the screen cover 1 of FIG. 1. FIG. 3 is a rear view of the screen cover 1 of FIG. 1. FIG. 4 is a front view of the screen cover 1 of FIG. 1.

Referring to FIGS. 1-4, the novel screen 1 can be disposable and reusable. The screen cover 1 can be used to protect one's hand(s) from germs while coming into physical contact with commonly used areas. The areas can include but are not limited to doors, door knobs, phones, sinks, faucets, toilet paper dispensers, toilets, hand wipe dispensers, elevator buttons, medical equipment, grocery carts, and public conveyances such as aircraft and bus and train seats, and other public seating areas, and the like.

The screen cover 1 can have a partial mitten configuration having a closed tip end 10, closed left side 20 from the tip end 10 to the left base end 28, closed right side 30 from the tip end 10 to the right base end 38, and can come in various sizes, such as but not limited to small for children, and large for adults.

The screen cover 1 can have an entirely closed front side 40 that can cover the inside of the palm area with the fingers being enclosed on the opposite side of the hand in the closed tip end 10 of the screen cover There can be a rear elastic band 50 that crosses over the back of the fingers as well as the back side of the hand closer to the risk area, so that the screen cover 1 can conform to and stay on the hand.

Across the back of the hand can be an elastic band portion 50 that allows the screen cover 1 to generally conform to and stay wrapped about the hand of the user. The back of the screen cover can have an openings 53, 55 above and below the elastic band 50. The shape of the screen cover 1 having a closed front side 40 having a dome shape, and a rear side that has a capital A appearing shape allows for a user to easily insert their hand into the screen cover 1 when it is to be used.

An extra elastic band 70 can also be across the front face of the screen cover inside of the cover itself to enhance the gripping action to the user's hand.

Unlike gloves and conventional mittens, the novel cover 1 has no separate finger and/or thumb portions, and instead covers all the fingers together.

The novel invention can be easily removed with another uncovered hand that does not become contaminated by any germs on the outside of the screen covered hand. To remove the screen cover 1 from the covered hand, the user can physically pinch (grip) between two fingers and inside surface of the screened cover 1. With the other hand the user can grab the elastic band 50 on the back of the hand while the covered hand is pinching the inside of the screen cover 1. Next, the user can pull up the elastic band 50 and pull the band 5 forward toward the covered fingertips. This will pull the screen cover 1 completely off and turn the screen cover 1 inside out so that any contaminated surface is now encapsulated. After the screen cover 1 is turned inside out, the user can stop pinching the inside of the screened cover 1 so that the screened cover in an inside out state is fully removed, and then thrown away.

If intended to be reused, the user can spray on a disinfectant or dip the entire screened cover in a disinfectant bath.

The invention can be put in kit form as a counter-germ kit. The kit can have one or two screened covers, along with a portable spray bottle having a disinfectant.

The screened cover 1 can be made with a washable fabric, such as but not limited to nylon and the like. Also, the screened cover 1 can have a paper layer with an outer layer of a waterproof material such as polyethylene, and the like. Additionally, the inside of the screen cover 1 can also have a washable surface.

Surgical scrub materials can also be used, and can combine polyethylene and cotton in 65/35 blend.

Figure 5:
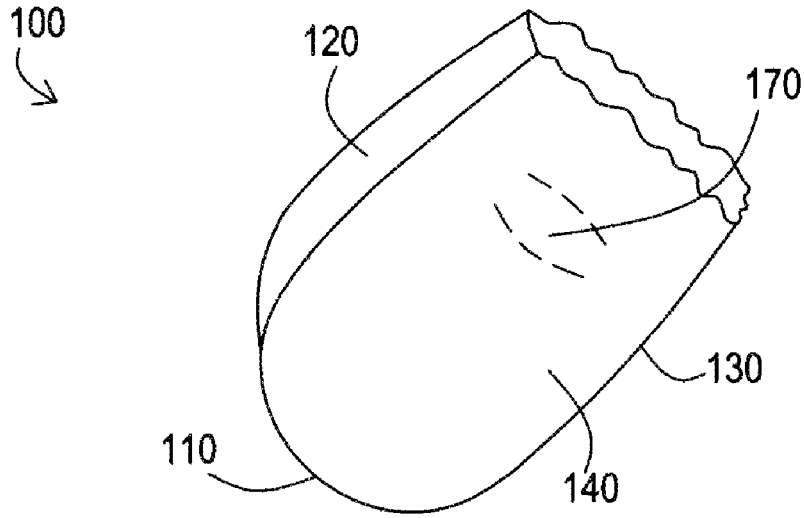
FIG. 5 is a front perspective view of another embodiment of the screen cover.
Figure 6:
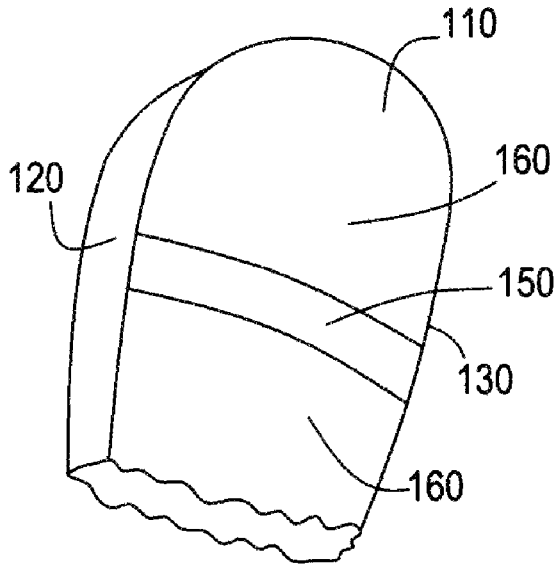
FIG. 6 is a rear perspective view of the screen cover of FIG. 5.

FIG. 5 is a front perspective view of another embodiment of the screen cover 100. FIG. 6 is a rear perspective view of the screen cover 100 of FIG. 5. The second embodiment can have a generally half moon with elongated shape with material completely closing the front side 140 and back side 160 as well as the tip end 110, left side 120 and right side 130 of the cover 100. The rear elastic band 150 can still be across the back side of the cover 100 with or without the extra elastic band 170 on the front side 140 of the cover 100.

The novel screen covers can be dispensed in boxes similar to those used to hold tissues, and the like.

The invention can be used as a disposable screen cover. Alternatively, the invention can be reusable as well.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A screen cover for protecting hands from germs, consisting of:

a single dome shaped sleeve having a single closed front side adapted for covering all fingers and a palm area of a front of a hand, a single closed rounded top end adaptable for covering front and back of all five tips of the hand, a single closed left side adapted for covering all of a left side of the hand from the palm area up all of the left side of the hand to the top end of the dome shaped sleeve, a single left side rear overlap flap adapted for overlapping a back of the left side of the hand from a rear wrist area of the hand to the top end of the dome shaped sleeve, a single closed right side adapted for covering all of a right side of the hand from the palm area up all of the right side of the hand to the top end of the dome shaped sleeve, a single right side rear overlap flap adapted for overlapping a back of the right side of the hand from the rear wrist area of the hand to the top end of the dome shaped sleeve, a single rear elastic band having a left end attached to the single side left side overlap flap, and a right end attached to the single right side overlap flap the single rear elastic band adapted for allowing the dome shaped sleeve to conform to and stay wrapped about the hand, a single upper rear side opening formed above the single rear elastic band and between the single left side overlap flap and the single right side overlap flap, a single lower rear side opening formed below the single rear elastic band and between the single left side overlap flap and the single right side overlap flap, the single upper rear side opening and the single lower rear side opening and the single left side overlap flap and the single right side overlap flap and the single rear elastic band forming a single capital A appearing shape, and a waterproof exterior surface on the dome shaped sleeve, wherein the single dome shaped sleeve is used for protecting all of the front of the hand and the tips of each finger and the left side of the hand and the back of the left side of the hand and the right side of the hand and the back of the right side of the hand from contacting germ contaminated surfaces.

2. The screen cover of claim 1, wherein the sleeve is reusable.

3. The screen cover of claim 1, wherein the sleeve is reusable and disposable.

4. The screen cover of claim 1, wherein the single dome shaped sleeve with the water proof exterior surface includes: a paper underlayer covered by a waterproof coating.

5. The screen cover of claim 4, wherein the single dome shaped sleeve with the water proof exterior surface includes: polyethylene.

6. The screen cover of claim 1, wherein the single dome shaped with the waterproof exterior includes: nylon.

7. The screen cover of claim 1, wherein the single dome shaved sleeve with the waterproof exterior surface includes: polyethylene and cotton in a blend.

8. The screen cover of claim 7, wherein the blend is 65 polyethylene and 35 cotton.

9. A single dome shaped sleeve forming a single screen cover for protecting a hand from germs, consisting of:

a single closed front side adapted for covering all fingers and a palm area of a front of a hand, a single closed rounded top end adaptable for covering front and back of all five tips of the hand, a single closed left side adapted for covering all of a left side of the hand from the palm area up all of the left side of the hand to the top end of the dome shaped sleeve, a single left side rear overlap flap adapted for overlapping a back of the left side of the hand from a rear wrist area of the hand to the top end of the single dome shaped sleeve, a single closed right side adapted for covering all of a right side of the hand from the palm area up all of the right side of the hand to the top end of the single dome shaped sleeve, a single right side rear overlap flap adapted for overlapping a back of the right side of the hand from the rear wrist area of the hand to the top end of the single dome shaped sleeve, a single rear elastic band having a left end attached to the single left side overlap flap, and a right end attached to the single right side overlap flap, the single rear elastic band adapted for allowing the single dome shaped sleeve to conform to and stay wrapped about the hand, a single upper rear side opening formed above the single rear elastic band and between the single left side overlap flap and the single right side overlap flap, a single lower rear side opening formed below the single rear elastic band and between the single left side overlap flap and the single right side overlap flap, the single upper rear side opening and the single lower rear side opening and the single left side overlap flap and the single right side overlap flap and the single rear elastic band forming a capital A appearing shape, a single front elastic band attached across a front face of the single dome shaped sleeve inside of the single closed front side of the single dome shaped sleeve, and a waterproof exterior surface on the single dome shaped sleeve, wherein the single dome shaped sleeve is used for protecting all of the front of the hand and the tips of each finger and the left side of the hand and the back of the left side of the hand and the right side of the hand and the back of the right side of the hand from contacting germ contaminated surfaces.

10. A single dome shaped sleeve forming a single screen cover for protecting a hand from germs, consisting of:

a single closed front side adapted for covering all fingers and a palm area of a front of a hand, a single closed rounded top end adaptable for covering front and back of all five tips of the band, a single closed left side adapted for covering all of a left side of the hand from the palm area up all of the left side of the hand to the top end of the dome shaped sleeve, a single left side rear overlap flap adapted for overlapping a back of the left side of the hand from a rear wrist area of the hand to the top end of the single dome shaped sleeve, a single closed right side adapted for covering all of a right side of the hand from the palm area up all of the right side of the hand to the top end of the single dome shaped sleeve, a single right side rear overlap flap adapted for overlapping a back of the right side of the hand from the rear wrist area of the hand to the top end of the single dome shaped sleeve, a single rear elastic band having a left end attached to the single left side overlap flap, and a right end attached to the single right side overlap flap, the single rear elastic band adapted for allowing the single dome shaped sleeve to conform to and stay wrapped about the hand, a single upper rear side opening formed above the single rear elastic band and between the single left side overlap flap and the single right side overlap flap, a single lower rear side opening formed below the single rear elastic band and between the single left side overlap flap and the single right side overlap flap, the single upper rear side opening and the single lower rear side opening and the single left side overlap flap and the single right side overlap flap and the single rear elastic band forming a capital A appearing shape, a single front elastic band attached across a front face of the single dome shaped sleeve inside of the single closed front side of the single dome shaped sleeve, and a waterproof exterior surface on the single dome shaped sleeve with a disinfectant, wherein the single dome shaped sleeve is used for protecting all of the front of the hand and the tips of each finger and the left side of the hand and the back of the left side of the hand and the right side of the hand and the back of the right side of the hand from contacting germ contaminated surfaces.

* * * * *